US010730105B2

(12) United States Patent
Dorner et al.

(10) Patent No.: US 10,730,105 B2
(45) Date of Patent: Aug. 4, 2020

(54) METHOD FOR PRODUCING A FLAT STEEL PRODUCT WITH AN AMORPHOUS, PARTIALLY AMORPHOUS OR FINE-CRYSTALLINE MICROSTRUCTURE AND FLAT STEEL PRODUCT WITH SUCH CHARACTERISTICS

(71) Applicant: ThyssenKrupp Steel Europe AG, Duisburg (DE)

(72) Inventors: Dorothée Dorner, Dusseldorf (DE); Christian Höckling, Duisburg (DE); Harald Hofmann, Dortmund (DE); Matthias Schirmer, Dusseldorf (DE); Markus Daamen, Aachen (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 73 days.

(21) Appl. No.: 14/763,249

(22) PCT Filed: Jan. 24, 2014

(86) PCT No.: PCT/EP2014/051416
§ 371 (c)(1),
(2) Date: Jul. 24, 2015

(87) PCT Pub. No.: WO2014/114756
PCT Pub. Date: Jul. 31, 2014

(65) Prior Publication Data

US 2015/0360285 A1 Dec. 17, 2015

(30) Foreign Application Priority Data

Jan. 25, 2013 (EP) ..... 13152793

(51) Int. Cl.
*B22D 25/06* (2006.01)
*C22C 38/02* (2006.01)
(Continued)

(52) U.S. Cl.
CPC ..... *B22D 25/06* (2013.01); *B22D 11/0611* (2013.01); *B22D 11/0622* (2013.01);
(Continued)

(58) Field of Classification Search
CPC ..... B22D 25/06; C21D 9/46; C21D 6/002; C21D 6/005; C21D 6/008; C22C 38/34;
(Continued)

(56) References Cited

U.S. PATENT DOCUMENTS 4,219,355 A 8/1980 DeCristofaro et al.
4,587,507 A * 5/1986 Takayama ..... H01F 1/15358 148/304

(Continued)

FOREIGN PATENT DOCUMENTS

CN 102149842 A 8/2011
CN 102605293 A 7/2012

(Continued)

OTHER PUBLICATIONS

Spitzer et al., Direct Strip Casting (DSC)—an Option for the Production of New Steel Grades, Process Metallurgy, 2003, pp. 724-731, No. 11/12.

*Primary Examiner* — Jenny R Wu
(74) *Attorney, Agent, or Firm* — The Webb Law Firm

(57) ABSTRACT

A method is provided for producing a 0.8-4.5 mm thick steel strip with an amorphous, partially amorphous or fine-crystalline microstructure with grain sizes in the range of 10-10000 nm and also a flat steel product made therefrom. A molten steel is cast into a cast strip in a casting device and cooled down at an accelerated rate. Along with Fe and impurities that are unavoidable for production-related reasons, the molten material contains at least two elements belonging to the group "Si, B, C and P". In this case, the following applies for the contents of these elements (in % by (Continued)

weight) Si: 1.2-7.0%, B: 0.4-4.0%, C: 0.5-4.0%, P: 1.5-8.0%. With a corresponding composition and a microstructure with corresponding characteristics, a flat steel product according to the invention has a HV0.5 hardness of 760-900.

14 Claims, 1 Drawing Sheet

(51) Int. Cl.

| | |
|---|---|
| ***C22C 45/02*** | (2006.01) |
| ***C22C 38/04*** | (2006.01) |
| ***C22C 38/06*** | (2006.01) |
| ***C22C 38/20*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***B22D 11/06*** | (2006.01) |
| ***C21D 1/18*** | (2006.01) |
| ***C22C 33/00*** | (2006.01) |
| ***C22C 38/00*** | (2006.01) |
| ***B22D 27/04*** | (2006.01) |
| ***C21D 6/00*** | (2006.01) |
| ***C21D 9/46*** | (2006.01) |
| ***C22C 1/00*** | (2006.01) |

(52) U.S. Cl.
CPC ..... *B22D 27/04* (2013.01); *C21D 1/18* (2013.01); *C21D 6/002* (2013.01); *C21D 6/005* (2013.01); *C21D 6/008* (2013.01); *C21D 9/46* (2013.01); *C22C 1/002* (2013.01); *C22C 33/003* (2013.01); *C22C 38/002* (2013.01); *C22C 38/02* (2013.01); *C22C 38/04* (2013.01); *C22C 38/06* (2013.01); *C22C 38/20* (2013.01); *C22C 38/24* (2013.01); *C22C 38/26* (2013.01); *C22C 38/28* (2013.01); *C22C 38/32* (2013.01); *C22C 38/34* (2013.01); *C22C 45/02* (2013.01); *C21D 2201/03* (2013.01)

(58) Field of Classification Search
CPC ..... C22C 38/32; C22C 38/28; C22C 38/26; C22C 38/24; C22C 38/20; C22C 38/06; C22C 38/00; C22C 45/02; C22C 1/002
See application file for complete search history.

(56) References Cited

U.S. PATENT DOCUMENTS

| | | | | |
|---|---|---|---|---|
| 5,322,113 | A | 6/1994 | Shibuya et al. | |
| 5,958,153 | A | 9/1999 | Sakamoto et al. | |
| 6,416,879 | B1 * | 7/2002 | Sakamoto | H01F 1/15308 148/100 |
| 7,282,103 | B2 * | 10/2007 | Sakamoto | C22C 33/003 148/304 |
| 2005/0252586 | A1 * | 11/2005 | Branagan | B22D 11/0622 148/561 |
| 2006/0102315 | A1 | 5/2006 | Lee et al. | |
| 2008/0213517 | A1 * | 9/2008 | Branagan | B22D 11/0622 428/34.1 |
| 2010/0043513 | A1 | 2/2010 | Hammer et al. | |
| 2010/0139814 | A1 * | 6/2010 | Makino | H01F 1/15308 148/403 |
| 2012/0325425 | A1 | 12/2012 | Wans et al. | |

FOREIGN PATENT DOCUMENTS

| | | | |
|---|---|---|---|
| CN | 102796969 | A | 11/2012 |
| DE | 102009048165 | A1 | 4/2011 |
| JP | 5964143 | A | 4/1984 |
| JP | 6274050 | A | 4/1987 |
| JP | 6376842 | A | 4/1988 |
| JP | 4266460 | A | 9/1992 |
| JP | 559483 | A | 3/1993 |
| JP | 5291019 | A | 11/1993 |
| JP | 6297109 | A | 10/1994 |
| JP | 8283919 | A | 10/1996 |
| JP | 2002220646 | A | 8/2002 |
| JP | 2003253408 | A | 9/2003 |
| JP | 2006500219 | A | 1/2006 |
| JP | 2007231415 | A | 9/2007 |
| JP | 2007536086 | A | 12/2007 |
| JP | 20081938 | A | 1/2008 |
| JP | 200824985 | A | 2/2008 |
| JP | 2010507023 | A | 3/2010 |
| JP | 2010508435 | A | 3/2010 |
| WO | 2008049069 | A2 | 4/2008 |
| WO | 2012095232 | A1 | 7/2012 |

* cited by examiner

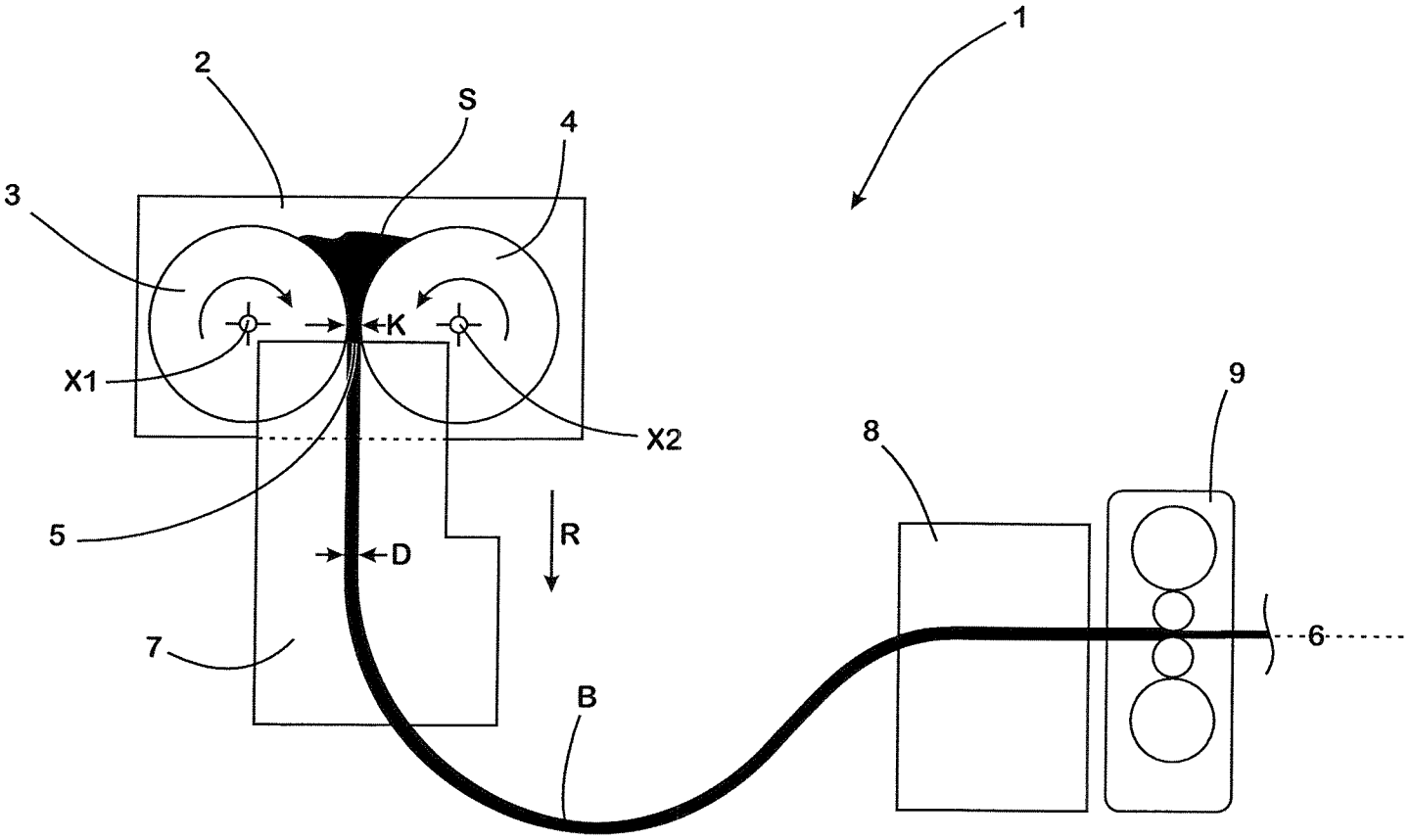
1
2
3
4
S
K
X1
X2
5
R
D
7
B
8
9
6

METHOD FOR PRODUCING A FLAT STEEL PRODUCT WITH AN AMORPHOUS, PARTIALLY AMORPHOUS OR FINE-CRYSTALLINE MICROSTRUCTURE AND FLAT STEEL PRODUCT WITH SUCH CHARACTERISTICS

CROSS-REFERENCE TO RELATED APPLICATIONS

This application is the United States national phase of International Application No. PCT/EP2014/051416 filed Jan. 24, 2014, and claims priority to European Patent Application No. 13152793.9 filed Jan. 25, 2013, the disclosures of which are hereby incorporated in their entirety by reference.

BACKGROUND OF THE INVENTION

Field of the Invention

The invention relates to methods for producing a flat steel product with an amorphous, partially amorphous or fine-crystalline microstructure, the fine-crystalline microstructure having grain sizes in the range of 10-10000 nm, and also to a flat steel product with an amorphous, partially amorphous or fine-crystalline microstructure of this type.

According to a first variant of the method, molten steel is thereby cast into a cast strip in a casting device and cooled down at an accelerated rate.

According to another variant of the method, to produce a flat steel product with an amorphous, partially amorphous or fine-crystalline microstructure, molten steel that contains along with iron and impurities that are unavoidable for production-related reasons at least two further elements belonging to the group "Si, B, C and P" is cast into a cast strip in a casting device of which the casting region is formed on at least one of its longitudinal sides by a wall that moves in the casting direction and is cooled during the casting operation. The region of the casting device in which the cast strip is formed is referred to here as the "casting region".

DESCRIPTION OF RELATED ART

WO 2008/049069 A2 discloses that flat steel products of the aforementioned type can be produced by strip casting methods. In strip casting, the molten steel is cast with a casting device, in which the casting region or solidifying region in which the cast strip is formed is bounded on at least one of its longitudinal sides by a wall that is moved along continuously during the casting operation.

An example of such a near-net-shape, continuous casting method or a casting device for producing a flat steel product is that known as a "two-roll casting device", technically also as a "twin-roll casting machine". In the case of a two-roll casting device, two casting rollers or casting rolls aligned axially parallel to one another rotate counter to one another during the casting operation and, in the region where they are closest together, bound a casting gap defining the casting region. During the casting operation, the casting rolls are intensely cooled, so that the molten material impinging on them solidifies to form a respective shell. The direction of rotation of the casting rolls is chosen here such that the molten material, and with it the shells formed from it on the casting rolls, are transported into the casting gap. The shells entering the casting gap are compressed into the cast strip under the effect of a sufficient strip-forming force.

Another casting device for strip casting is based on the principle of "belt-casting" technology. In the case of a casting device that is intended for the belt-casting method, a liquid steel is poured onto a circulating casting belt by way of a feeding system. The running direction of the belt is chosen here such that the molten material is transported away from the feeding system. Above the lower, first casting belt there may be arranged a second casting belt, which circulates in the opposite direction to the first casting belt.

Irrespective of whether one or two casting belts is/are provided, also in the case of the aforementioned method at least one casting belt bounds the mold by which the cast strip is formed. The respective casting belt is in this case intensively cooled, so that the molten material coming into contact with the casting belt concerned is solidified at the reversal point of the casting belt away from the feeding system, to form a strip that can be removed from the casting belt.

The cast strip leaving the respective casting device is drawn off, cooled down and passed on for further processing. This further processing may comprise heat treatment and hot rolling. The particular advantage of strip casting here is that the working steps following the strip casting can be performed in a continuous, uninterrupted sequence.

It is mentioned in the already aforementioned WO 2008/049069 A2 that steels that are suitable for producing steel strips with an amorphous, partially amorphous or fine-crystalline microstructure may be alloys based on iron and one or more elements from the group "B, C, Si, P and Ga", it being possible for contents of Cr, Mo, W, Ta, V, Nb, Mn, Cu, Al, Co and rare earths to be additionally present along with these elements. Alloys of such a composition are to be used to produce strips cast by strip casting that have a fine-grained, nanocrystalline or virtually nanocrystalline microstructure in which over 90% of the grains are of a size of 5 Å-1 μm, the melting point of the steel of which the cast strips consist lying in the range of 800-1500° C., the critical cooling-down rate of the steel being less than $10^5$ K/s and the cast strips containing α-Fe and/or γ-Fe phases.

The thoughts expressed in WO 2008/049069 A2 are confined to a discussion of the working steps that are expedient for producing a cast strip with an amorphous, partially amorphous or fine-crystalline microstructure.

Along with the prior art discussed above, U.S. Pat. No. 6,416,879 B1 discloses an Fe-based amorphous thin strip with a thickness of 10-100 μm that is intended to contain in atomic percent 78-90% Fe, 2-4.5% Si, 5-16% B, 0.02-4% C and 0.2-12% P and have optimized magnetic properties. To produce the thin strip, a molten material of a corresponding composition is poured under laboratory conditions onto a quickly rotating cooling roller, solidifies there and is then drawn off from the roller. In this way, casting rates that lie in the range of about 25 m/s are achieved. It is also mentioned that the production of such a thin strip is also intended to be accomplished in a two-roller casting machine. However, no further explanations are given. This prior art also does not reveal how the known procedure could be put into practice on an industrial scale, where greater sheet thicknesses and other properties of the strip obtained are desired.

Prior art similar to the prior art described above is disclosed by U.S. Pat. No. 4,219,355. The aim there is likewise to produce a thin, film-like strip with a thickness of 30-100 μm that has optimized magnetic properties. For this purpose, in this case too a suitably composed molten material is poured onto a rotating roller, on which it is cooled down at a rate of $10^5$-$10^{6\circ}$ C./s, in order to produce an amorphous microstructure. But it similarly remains open how this is intended to be put into practice on an industrial scale if flat products of a greater thickness and with a different set of requirements are to be produced.

Finally, DE 10 2009 048 165 A1 discloses a method for strip casting a steel with a chromium content of over 15% by weight, in which molten steel is cast in a horizontal strip casting installation that comprises a melting furnace, a foundry ladle and a conveyor belt for receiving and cooling down a liquid steel strip flowing out from the foundry ladle. The thickness of the steel strips produced in this way is 8-25 mm. What cooling-down rates can be achieved in the case of such an installation and whether they would be suitable for producing for example one of the flat steel products explained above remains open here.

Against the background of the prior art explained above, the object of the invention was therefore to provide methods suitable in practice for producing flat steel products that have an amorphous, partially amorphous or fine-grained microstructure.

In addition, a flat steel product that can be produced at low cost in a way suitable in practice should be provided. A flat steel product is understood here as meaning a cast or rolled steel strip or sheet and also sheet bars, blanks or the like obtained therefrom.

SUMMARY OF THE INVENTION

The various embodiments of the invention that are mentioned here are based on the common concept that flat steel products consisting of steels solidifying in an amorphous, partially amorphous or nanocrystalline or fine-crystalline form can be produced by near-net-shape casting methods. The steels respectively processed according to the invention are composed here in such a way that the desired microstructural state is reliably obtained. Wherever figures in "%" are given here in connection with steel alloys, unless otherwise expressly stated they should always be understood as meaning "% by weight".

At the same time, the invention mentions operating conditions under which cast strips with an amorphous, partially amorphous or fine-crystalline structure can be produced with sufficient reproducibility for practical purposes from a steel that contains along with iron and unavoidable impurities at least two further elements from the group "Si, B, Cu and P".

The method according to the invention for producing a steel strip with an amorphous, partially amorphous or fine-crystalline microstructure provides that, along with iron and impurities that are unavoidable for production-related reasons, the molten steel contains at least two further elements from the group "Si, B, C and P". According to the invention, the contents of the two elements from the group "Si, B, C and P" that are at least present, lie in the following ranges (in % by weight) respectively:

Si: 1.2-7.0%,
B: 0.4-4.0%,
C: 0.5-4.0%,
P: 1.5-8.0%.

Preferred in principle according to the invention are those alloys in which, along with the constituents that are respectively unavoidable for production-related reasons but are ineffective with regard to the properties of the flat steel products produced according to the invention and along with iron, only two further elements from the group "Si, B, C and P" are present, in the quantities specified according to the invention. In the case of such alloys, along with Fe and unavoidable impurities, only the pairs of alloying elements Si and B, Si and C, Si and P, B and C, B and P or C and P are then respectively present in the steel. Steel alloys composed in such a way are suitable in particular for amorphous or partially amorphous solidification. If required, the alloying pairs mentioned can in this case be supplemented within the specifications according to the invention by one or two other alloying elements of the group "Si, B, C and P", respectively. At the same time, it is equally possible that the alloying elements of the group "Si, B, C and P" that do not respectively lie within the specifications according to the invention are indeed present in measurable quantities but are contained in amounts in which, though they may have an effect, contribute in a minor way, if at all, to the forming of the microstructure desired according to the invention. In other words, according to the invention, two elements from the group "Si, B, C and P" must be present in the respective quantities specified according to the invention in a for the production of flat steel product according to the invention, which does not exclude the possibility that the other elements respectively of the group "Si, B, C and P" are present in quantities that lie outside the specifications according to the invention. Presence of an alloying element of the group "Si, B, C and P" respectively contained in an amount outside the specifications according to the invention is possible in particular whenever its content lies below the lower limit prescribed according to the invention for the content of the element concerned.

The broadest composition of a steel according to the invention consequently comprises as obligatory constituents at least two of the elements boron, silicon, carbon and phosphorus and also as the remainder iron and unavoidable impurities. These elements prove to be particularly advantageous because they can be procured at relatively low costs. With the contents of these elements stated in the claims, the production method according to the invention allows reproducible production of a steel product with an amorphous, partially amorphous or fine-crystalline microstructure. A flat steel product produced according to the invention has a fine-crystalline microstructure with grain sizes in the range of 10-10000 nm, it often being the case that flat steel products that can be produced in practice are restricted in their grain sizes to a maximum of 1000 nm.

C in quantities of up to 4.0% by weight is conducive to the amorphization of the material in flat steel products produced according to the invention. In order to be certain to achieve this effect, the C content may be set to at least 1.0% by weight, in particular 1.5% by weight.

Settings of the contents of Si, B, C and P that are expedient for practical purposes are obtained whenever the following applies for the Si content % Si: 2.0% by weight≤% Si≤6.0% by weight, in particular 3.0% by weight≤% Si≤5.5% by weight, whenever the following applies for the B content % B: 1.0% by weight≤% B≤3.0% by weight, in particular 1.5% by weight≤% B≤3.0% by weight, whenever the following applies for the C content % C: 1.5% by weight≤% C≤3.0% by weight or whenever the following applies for the P content % P: 2.0% by weight≤% P≤6.0% by weight. It may be favorable here in the respective case to add one or more of the elements Si, B, C and P in the specified more narrowly limited quantities, while the other elements of the group "Si, B, C and P" are added within the maximum specifications allowed according to the invention. Equally, it may be expedient to add each of the elements that are present in the quantities respectively according to the invention in the narrower limits specified here.

Even if it is regarded as advantageous according to the invention to restrict the group of alloying elements of a steel according to the invention, along with Fe and unavoidable impurities, to Si, B, C and P, it may under certain circumstances be expedient for the setting of specific properties of the flat steel products obtained optionally to add to the steel one or more of the elements from the group "Cu, Cr, Al, N, Nb, Mn, Ti and V". The quantitative ranges that respectively come into consideration according to the invention for this are (in % by weight):

Cu: up to 5.0%, in particular up to 2.0%,
Cr: up to 10.0%, in particular up to 5.0%,
Al: up to 10.0%, in particular up to 5.0%,
N: up to 0.5%, in particular up to 0.2%,
Nb: up to 2.0%,
Mn: up to 3.0%,
Ti: up to 2.0%,
V: up to 2.0%.

The addition of Cu allows the ductility of the material to be increased, whereas the action of Cr lies primarily in an improvement in the corrosion resistance. The addition of Al also increases the corrosion resistance, but has an assisting effect on the formation of an amorphous microstructure. N may be regarded as a possible substitute for C. Thus, in the same way as higher C contents, the presence of N assists the enhanced formation of an amorphous microstructure.

To be able to use the positive influences of the optionally added alloying elements Cu, Cr, Al and N, the molten steel may optionally contain (in % by weight) at least 0.1% Cu, at least 0.5% Cr, at least 1.0% Al and at least 0.005% N, respectively.

The steel alloy according to the invention may be produced with alloying elements that are commonly available in the steel industry and comparatively inexpensive as obligatory constituents.

On account of the high contents of "lightweight" elements, considerable advantages of lightweight construction in comparison with conventional steels are conceivable as a result of the reduced density and the high strength.

Typical cooling-down rates for successfully producing a flat steel product alloyed according to the invention with an amorphous, partially amorphous or fine-crystalline microstructure lie in the range of 100-1100 K/s. It has surprisingly been found here that it is possible with such cooling-down rates which can also be realized on an industrial scale, to produce in an operationally reliable manner strips with the desired microstructure with greater thicknesses than are provided in the case of the prior art explained above.

In keeping with the explanations given above, a variant of the method according to the invention for producing a steel strip with an amorphous, partially amorphous or fine-crystalline microstructure is based on a molten steel composed in the way according to the invention being cast into a cast strip in a casting device of which the casting region in which the cast strip is formed is formed on at least one of its longitudinal sides by a wall that moves and is cooled during the casting operation. The wall bounding the casting region and moving during the casting operation may be formed in particular by two counter-rotating casting rolls or a belt moving in the casting direction during the casting operation. According to the invention, the molten steel is cooled down by contact with the moving wall at at least 200 K/s.

The explanations given here concerning the composition of the steel according to the invention apply to all of the methods according to the invention that are presented here and equally to a flat steel product according to the invention.

The formation of the desired microstructure of the flat steel product can be ensured by the rapid cooling down being carried out in practice to below the glass transition temperature $T_G$ of the respective steel. In this way, initially an amorphous or partially amorphous microstructure is formed.

On the basis of this microstructure, a fine-crystalline microstructure can then be produced by means of a subsequent heat treatment above the crystallization temperature $T_x$ as a result of the consequent crystal nucleation and crystallization. This procedure has the advantage that the fine granularity can be set very precisely, a very homogeneous grain size distribution with a very small range of fluctuation being obtained on account of the large number of crystallization nuclei forming.

In order to ensure that, even after leaving the respective casting region, the cast strip is cooled down at a rate sufficient for the formation of an amorphous or partially amorphous microstructure to the glass transition temperature critical for this of the respectively processed steel, the rapid cooling down of the cast strip that commences in the casting region can be continued after it leaves the casting region. The continued cooling down in this case advantageously follows on directly after leaving the casting region, so that an accelerated temperature decrease that is to the greatest extent continuous is ensured in the cast strip until the respectively desired microstructural state is achieved.

An additional cooling device which is connected directly to the casting region of the casting device used for casting the cast strip may be provided for this purpose. With such a cooling device, the molten steel can be cooled down at the cooling-down rate specified according to the invention to below the glass transition temperature $T_G$, in order to produce an amorphous or partially amorphous microstructure in the cast flat steel product. During cooling down of the molten steel, the additional cooling device ensures that, in cases in which there has only been insufficient removal of heat in the casting region of the casting device itself through the contact with the moving and cooled wall of the casting region, the cooling down of the strip is continued so quickly after the casting region that the microstructural state to be produced according to the invention is reliably achieved.

A further advantage of the additional cooling taking place after the casting device is that, with such cooling, a specifically adapted cooling-down curve can be varied in a controlled manner. This may be expedient if specifically cast strips with a partially amorphous or fine-crystalline microstructure are to be obtained as a result of the casting and cooling-down process. Thus, the cooling down may be performed in such a way that, although it is cooled down below the glass transition temperature $T_G$ in an accelerated manner, it is not cooled down at a rate sufficient for fashioning a completely amorphous microstructure.

As an alternative, the cast strip may be cooled down at an accelerated rate in keeping with the specifications according to the invention, but this cooling down is terminated before reaching the glass transition temperature $T_G$ of the respectively processed steel. This approach represents a first possibility of producing a predetermined, fine-crystalline microstructure in the flat steel product obtained. The fine-crystalline microstructure is formed here directly from the molten material, in that crystallization controlled by way of the additional cooling is allowed.

Another approach to producing a flat steel product according to the invention with a fine-crystalline microstructure is that of initially producing a strip with an amorphous or partially amorphous microstructure which is only then transformed into a fine-crystalline state by an annealing process and a process of crystallization brought about as a result. The particular feature of this procedure is that the crystallization takes place at a large number of crystal nuclei, and therefore the crystal grains forming are distributed very uniformly in the material.

The crystallization temperature $T_x$, important for the fashioning of the fine-crystalline microstructure, lies on average approximately 30-50 K above the glass transition temperature $T_G$ of the respectively processed steel. For the production of a flat steel product according to the invention with an amorphous or partially amorphous microstructure, it is therefore necessary when cooling down the molten material to go below the temperature $T_G$ as quickly as possible with a cooling-down rate $v>v_{crit}$, where, according to the invention, $v_{crit}$ is 200 K/s. In this way, the amorphous state of the steel is "frozen in", whereas the crystallization of the steel commences during heating up to a heat treatment temperature lying above the temperature $T_x$.

The additional cooling device that is provided as a necessity according to the invention may be formed in such a way that a cooling medium is applied directly to the cast strip. This cooling medium may be water, liquid nitrogen or another correspondingly effective cooling liquid. As an alternative or in addition, cooling gases, such as gaseous nitrogen, hydrogen, a gas mixture or water mist, may also be applied. Cooling devices suitable for this purpose are known from the prior art (KR2008/0057755A).

The cooling-down rate that is critical for achieving an amorphous microstructure depends inter alia on the composition of the molten steel that is respectively set. Thus, it may be expedient to provide the cooling-down rates of over 250 K/s, over 450 K/s or even over 800 K/s.

Consequently, by means of the method according to the invention, a strip alloyed in the way according to the invention, with an amorphous or partially amorphous microstructure, can be specifically produced.

One particular aspect of fine-crystalline steels of the type produced according to the invention is their capability of structural superplasticity. Accordingly, on the basis of flat steel products according to the invention, extremely complex component geometries can be obtained by grain boundary sliding processes at elevated temperatures (thermal activation).

As already mentioned above, a possible and particularly reliable way of producing a flat steel product with a fine-crystalline microstructure provides that the cast strip leaving the casting gap of the casting device, and optionally additionally cooled down thereafter, has an amorphous or partially amorphous microstructure, and that the cast strip with such characteristics is subsequently annealed at an annealing temperature $T_{anneal}$, corresponding at least to the crystallization temperature $T_x$ of the respective steel, until the desired microstructural state is achieved. With steel compositions lying within the specifications according to the invention, the annealing temperatures $T_{anneal}$ suitable for this are 500-1000° C. In order to achieve a purely fine-crystalline microstructure, annealing times of 2 s-2 h are typically sufficient for this, depending on the actually chosen composition, respectively.

The strip speeds at which the cast strip leaves the casting gap typically lie in practice in the range of 0.3-1.7 m/s.

The strip thicknesses with which the strip cast and cooled down according to the invention leaves the casting gap typically lie in the range of 0.8-4.5 mm, in particular 0.8-3.0 mm.

After the casting of the strip and the cooling that is optionally additionally carried out thereafter, the cast strip may be subjected to hot rolling, in which the initial hot-rolling temperature should be 500-1000° C. The inline hot-rolling steps following the casting and cooling-down process allow on the one hand the desired final thickness of the strip and on the other hand the surface finish to be set and also allow the microstructure to be optimized, in that for example cavities that are still present in the cast state are closed. In order to maintain an amorphous or partially amorphous state of the cast strip, the cast strip may also be hot rolled into the hot strip at an initial hot-rolling temperature lying in the range between the glass transition temperature $T_G$ and the crystallization temperature $T_x$.

Suitable for example as the casting device for carrying out the method according to the invention is a two-roll casting device, the rolls of which, rotating counter to one another about axes aligned axially parallel to one another, respectively form a cooled longitudinal wall of the casting region in which the strip is formed that moves along continuously in the casting direction during the casting operation.

The methods according to the invention require only minor modifications to existing methods or devices for the continuous production of near-net-shape flat steel products.

BRIEF DESCRIPTION OF THE DRAWINGS

The invention is explained in more detail below on the basis of a drawing representing an exemplary embodiment. The single FIGURE schematically shows a device for producing a cast strip in a lateral view.

DETAILED DESCRIPTION OF THE INVENTION

The installation 1 for producing a cast strip B comprises a casting device 2, which is constructed as a conventional two-roll casting device, and accordingly comprises two rolls 3, 4 rotating counter to one another about axes X1, X2 aligned axially parallel to one another and at the same height. The rolls 3, 4 are arranged at a distance from one another establishing the thickness D of the cast strip B to be produced and thus bound at their longitudinal sides a casting region 5, which is formed as a casting gap and in which the cast strip B is formed. On its narrow sides, the casting region 5 is sealed off in a similarly known way by side plates that are not visible here, which are pressed against the end faces of the rolls 3, 4.

During the casting operation, the intensively cooled rolls 3, 4 rotate and in this way form longitudinal walls of a casting mold that is formed by the rolls 3, 4 and the side plates, which walls move along continuously during the casting operation. The direction of rotation of the rolls 3, 4 is in this case directed in the direction of gravitational force R into the casting region 5, so that, as a consequence of the rotation, molten material S is transported from a molten pool in the space above the casting region 5 between the rolls 3, 4 into the casting region 5. The molten material S thereby solidifies when it comes into contact with the circumferential surface of the rolls 3, 4, on account of the intensive heat removal taking place there, to form a respective shell. The shells adhering to the rolls 3, 4 are transported by the rotation of the rolls 3, 4 into the casting region 5 and compressed there under the effect of a strip-forming force K into the cast strip B. The cooling output effective in the casting region 5 and the strip-forming force K are in this case made to match one another in such a way that the cast strip B continuously leaving the casting region 5 is to the greatest extent completely solidified.

In order to suppress crystallization effects, after the casting region 5 the cast strip B runs into a cooling device 7, which applies a cooling medium to the cast strip B, so that it cools down further. The cooling down by the cooling device 7 directly follows on here after the casting region 5 and in this case takes place so intensely that the temperature T of the cast strip B continuously decreases, until it lies below the glass transition temperature $T_G$ of the respectively cast molten material S. Any crystallization of the microstructure of the cast strip B is thus suppressed, so that, as before, it is in an amorphous state when it reaches the transporting section 6.

The strip B leaving the casting region 5 is initially transported away vertically in the direction of gravitational force R and subsequently deflected in a known way in a continuously curved arc into a horizontally aligned transporting section 6.

On the transporting section 6, the cast strip B may subsequently run through a heating-up device 8, in which the strip B is heated up throughout at an annealing temperature $T_{anneal}$, lying above the crystallization temperature $T_x$ of the respectively cast molten steel S, over an annealing time $t_{anneal}$. The aim of this heat treatment is the controlled formation in the cast strip B of a fine-crystalline microstructure with grain sizes that lie in the range of 10-10000 nm. The cast strip B heat-treated in this way is subsequently hot-rolled into hot strip WB in a hot-rolling stand 9.

In the installation 1, a cast strip B has been respectively produced from three molten steels S with the compositions Z1, Z2, Z3 stated in Table 1. For each composition Z1, Z2, Z3, the thickness D of the strips B cast from the respective molten steel S, the cooling-down rate AR respectively achieved in the cooling down of the molten material S in the casting region 5, the cooling-down rate ARZ respectively achieved in the cooling down of the cast strip B leaving the casting region 5 in the additional cooling device 7, and also the target temperature $T_Z$ of the additional cooling down are stated. Furthermore, the microstructural state and the possibly present constituents of the microstructure of the strip obtained are presented in Table 2.

Different heat treatments have been carried out in the heating-up device 8 on two specimens of the cast strip B produced in the way explained above from the molten steel S with the composition Z1. The annealing temperature $T_{anneal}$ being set and the annealing time $t_{anneal}$ of the heat treatment, respectively, are compared in Table 3.

It was found that, before the heat treatment, the cast strip B already had a fine-crystalline microstructure of α-Fe, $Fe_2B$, $Fe_3B$ and $Fe_3Si$ with an HV0.5 hardness of 840-900. Also after the heat treatment, the microstructure consisted of α-Fe, $Fe_2B$, $Fe_3B$ and $Fe_3Si$, but then the HV0.5 hardness was 760-810.

It goes without saying that the described heat treatment by means of the heating-up device 8 and also the hot rolling with the hot-rolling stand 9 are only optional method steps.

The invention consequently provides methods for producing a steel strip B with an amorphous, partially amorphous or fine-crystalline microstructure with grain sizes in the range of 10-10000 nm and also a flat steel product with corresponding characteristics. According to the invention, for this purpose molten steel is cast into a cast strip (B) in a casting device (2) and cooled down in an accelerated manner. Along with Fe and impurities that are unavoidable for production-related reasons, the molten material contains at least two further elements belonging to the group "Si, B, C and P". According to a first variant of the method, the following applies for the contents of these elements (in % by weight) Si: 1.2-7.0%, B: 0.4-4.0%, C: 0.5-4.0%, P: 1.5-8.0%. According to a second variant of the method, the molten steel containing Si, B, C and P is cast into a cast strip (B) in a casting device (2), the casting region (5) of which is formed on at least one of its longitudinal sides by a wall that moves in the casting direction (G) and is cooled during the casting operation, the molten steel (S) being cooled down by contact with the moving and cooled wall at a cooling-down rate of at least 200 K/s.

DESIGNATIONS

1 Installation for producing a cast strip B
2 Casting device
3.4 Rolls of the casting device 2
5 Casting region
6 Horizontally aligned transporting section
7 Cooling device
8 Heating-up device
9 Hot-rolling stand
B Cast strip
D Thickness of the cast strip B
R Direction of gravitational force
S Molten material
K Strip forming force
X1,X2 Axes of rotation of the rolls 3, 4

TABLE 1

| | C | Si | Mn | P | Al | Cr | Cu | Nb | Ti | V | B |
|---|---|---|---|---|---|---|---|---|---|---|---|
| Z1 | 0.038 | 5.5 | 0.44 | 3.3 | 0.005 | 0.3 | 0.133 | 0.059 | 0.11 | 0.048 | 2.0 |
| Z2 | 0.041 | 3.3 | 0.51 | 0.025 | 0.005 | 0.4 | 0.09 | 0.001 | 0.09 | 0.055 | 2.2 |
| Z3 | 1.5 | 3.0 | 0.64 | 0.030 | 1.30 | 0.4 | 0.08 | 0.002 | 0.08 | 0.045 | 1.6 |

Figures are given in % by weight, the remainder iron and unavoidable impurities

TABLE 2

| | D [mm] | AR [K/s] | ARZ [K/s] | Tz [° C.] | Microstructure |
|---|---|---|---|---|---|
| Z1 | 1.2 | 900 | 900 | 400 | amorphous |
| Z2 | 1.2 | 1050 | 600 | 600 | fine-crystalline α-Fe, $Fe_2B$, $Fe_3B$, $Fe_3Si$ |
| Z3 | 1.1 | 700 | 500 | 500 | fine-crystalline, α-Fe, $Fe_2C$, $Fe_2B$, $Fe_3B$, $Fe_3Si$ |

TABLE 3

| | D [mm] | $T_{anneal}$ [° C.] | $t_{anneal}$ [° C.] | Microstructure |
|---|---|---|---|---|
| Z1 | 1.2 | 600° C. | 1 min | partially amorphous (amorphous + α-Fe, $Fe_2B$, $Fe_3B$, $Fe_3Si$) |
| Z1 | 1.2 | 600° C. | 20 min | fine-crystalline α-Fe, $Fe_2B$, $Fe_3B$, $Fe_3Si$ |

The invention claimed is:

1. A method for producing a flat steel product with an amorphous, a partially amorphous, or a fine-crystalline microstructure, the fine-crystalline microstructure having grain sizes in the range of 10-10000 nm, comprising:

casting molten steel into a cast strip in a casting device comprising two rolls rotating counter to one another wherein a molten pool of metal feeds a gap between the two rolls;

cooling said molten steel at an accelerated rate in a casting region defined by the gap between the two rolls to form a cast strip;

further cooling the cast strip leaving the casting region using an additional cooling device, wherein the molten steel is cooled down at a cooling rate of at least 200 K/s to a temperature below the glass transition temperature $T_G$; and hot-rolling the cast strip at an initial hot-rolling temperature lying in the range between the glass transition temperature $T_G$ and the crystallization temperature $T_x$ to form a flat steel product, wherein the thickness of the cast strip is 0.8-4.5 mm and the molten steel comprises, along with iron and unavoidable impurities, 1.2-7.0% Si and at least one element selected from the group consisting of B, C and P, wherein (in % by weight):

B: 0.4-4.0%,

C: 0.5-4.0%, and/or

P: 1.5-8.0% and also optionally one or more elements selected from the group consisting of Cu, Cr, Al, N, Nb, Mn, Ti and V, wherein (in % by weight):

Cu: up to 5.0%,

Cr: up to 10.0%,

Al: up to 10.0%,

N: up to 0.5%,

Nb: up to 2.0%,

Mn: up to 3.0%,

Ti: up to 2.0%, and/or

V: up to 2.0%.

2. The method as claimed in claim 1, wherein the molten steel is cooled at a cooling rate of up to 1100 K/s.

3. The method as claimed in claim 1, wherein the casting region of the casting device is formed on at least one longitudinal side by a wall that moves in a casting direction and is cooled during the casting operation, and wherein the molten steel is cooled by contact with the moving and cooled wall at a cooling rate of at least 200 K/s.

4. The method as claimed in claim 3, wherein, after leaving the casting region, the cast strip continues to be cooled at a cooling rate of at least 200 K/s by the additional cooling device.

5. The method as claimed in claim 3, wherein the cast strip leaving the casting region is cooled continuously until its temperature is below the glass transition temperature $T_G$ of the respective steel.

6. The method as claimed in claim 3, further comprising hot-rolling the cast strip at an initial hot-rolling temperature of 500-1000° C. to form a hot strip.

7. The method as claimed in claim 3, further comprising annealing the cast strip leaving the casting device and having an amorphous or partially amorphous microstructure at an annealing temperature $T_{anneal}$ corresponding at least to the crystallization temperature $T_x$ of the respective steel.

8. The method as claimed in claim 7, wherein the annealing temperature $T_{anneal}$ lies in the range of 500-1000° C.

9. The method as claimed in claim 1, wherein the molten steel contains at least one element selected from the group consisting of Cu, Cr, Al, N, Nb, Mn, Ti and V.

10. The method as claimed in claim 1, wherein, for at least one of the elements selected from the group consisting of B, C, and P, at least one of the following respectively applies (in % by weight):

B: 0.4-3.0%,

C: 0.5-3.0% and/or

P: 2.0-6.0%.

11. The method as claimed in claim 1, wherein the molten steel comprises (in % by weight) at least one element selected from the group consisting of Cu, Cr, Al and N, wherein (in % by weight):

Cu: 0.1-5.0%,

Cr: 0.5-10.0%,

Al: 1.0-10.0%, and/or

N: 0.005-0.5%.

12. The method as claimed in claim 1, wherein a strip speed at which the cast strip leaves the gap is 0.3-1.7 m/s.

13. The method as claimed in claim 1, wherein the Si is 2.0-6.0%.

14. A flat steel product made according to the method of claim 1 with a thickness of 0.8-4.5 mm, comprising a steel that comprises, along with iron and unavoidable impurities, 1.2-7.0% Si and at least one element selected from the group consisting of B, C and P, wherein (in % by weight):

B: 0.4-4.0%,

C: 0.5-4.0%, and

P: 1.5-8.0%, and optionally one or more elements selected from the group consisting of Cu, Cr, Al, N, Nb, Mn, Ti and V, wherein (in % by weight):

Cu: up to 5.0%,

Cr: up to 10.0%,

Al: up to 10.0%,

N: up to 0.5%,

Nb: up to 2.0%,

Mn: up to 3.0%,

Ti: up to 2.0%, and/or

V: up to 2.0%, and having an amorphous, partially amorphous or fine-crystalline microstructure with grain sizes that lie in the range of 10-10000 nm, wherein the HV0.5 hardness of the flat steel product is 760-900.

* * * * *